US009332806B2

(12) United States Patent
Guardado

(10) Patent No.: US 9,332,806 B2
(45) Date of Patent: May 10, 2016

(54) SHOE HAVING CONVERTIBLE HEEL

(71) Applicant: Cliver Guardado, Redondo Beach, CA (US)

(72) Inventor: Cliver Guardado, Redondo Beach, CA (US)

( * ) Notice: Subject to any disclaimer, the term of this patent is extended or adjusted under 35 U.S.C. 154(b) by 0 days.

(21) Appl. No.: 14/638,334

(22) Filed: Mar. 4, 2015

(65) Prior Publication Data

US 2015/0264994 A1 Sep. 24, 2015

Related U.S. Application Data

(60) Provisional application No. 61/954,768, filed on Mar. 18, 2014.

(51) Int. Cl.

| | |
|---|---|
| ***A43B 3/24*** | (2006.01) |
| ***A43B 21/36*** | (2006.01) |
| ***A43B 21/42*** | (2006.01) |
| ***A43B 21/52*** | (2006.01) |
| ***A43B 21/433*** | (2006.01) |
| ***A43B 21/22*** | (2006.01) |

(52) U.S. Cl.

CPC ..... *A43B 21/42* (2013.01); *A43B 3/246* (2013.01); *A43B 21/22* (2013.01); *A43B 21/433* (2013.01); *A43B 21/52* (2013.01)

(58) Field of Classification Search

CPC ..... A43B 21/36; A43B 21/42; A43B 21/433; A43B 21/22; A43B 3/24

USPC ..... 36/100; D2/986, 946, 918, 925, 965, D2/966

See application file for complete search history.

(56) References Cited

U.S. PATENT DOCUMENTS

| | | | | |
|---|---|---|---|---|
| 3,174,234 | A * | 3/1965 | Weitzner | A43B 3/24 36/1 |
| 3,309,651 | A * | 3/1967 | Epstein | H04B 13/02 250/338.1 |
| 3,325,918 | A * | 6/1967 | Weitzner | A43B 3/00 36/1 |
| 4,146,981 | A * | 4/1979 | Renaldo | A43B 3/24 36/100 |
| 4,910,885 | A * | 3/1990 | Hsieh | A43B 21/433 36/35 R |
| 6,021,586 | A * | 2/2000 | Bucalo | A43B 3/24 36/42 |
| 7,578,075 | B1 | 8/2009 | Kemp | |
| 7,877,902 | B2 * | 2/2011 | Pieriboni | A43B 3/24 36/100 |
| 8,453,351 | B1 | 6/2013 | Hale | |
| 8,505,218 | B2 | 8/2013 | Angiulo et al. | |
| 8,943,713 | B1 * | 2/2015 | Eidson | A43B 21/00 36/136 |
| 2002/0133980 | A1 * | 9/2002 | Pan | A43B 21/24 36/100 |
| 2006/0101670 | A1 * | 5/2006 | Bucalo | A43B 3/24 36/81 |
| 2007/0289167 | A1 | 12/2007 | Pieriboni | |
| 2012/0174435 | A1 | 7/2012 | Ruano Cerdan et al. | |
| 2013/0067770 | A1 | 3/2013 | Sherwood et al. | |
| 2013/0091736 | A1 * | 4/2013 | Worley | A43B 1/0027 36/105 |
| 2013/0160332 | A1 | 6/2013 | Yoon | |
| 2013/0312285 | A1 | 11/2013 | Sharma et al. | |
| 2014/0137436 | A1 | 5/2014 | Saccullo et al. | |

* cited by examiner

*Primary Examiner* — Jila M Mohandesi

(74) *Attorney, Agent, or Firm* — Tsircou Law, P.C.

(57) ABSTRACT

A shoe is provided that includes a sole having a stow cavity, a first heel assembly and a second heel assembly that can transfer from a stowed position in the stow cavity to a deployed position. In the deployed position, the second heel is below a heel portion of the sole such that the contact surface of the second heel assembly is positioned to contact the ground when worn, such that the shoe has a greater contact surface area with the second heel assembly in the deployed position.

20 Claims, 10 Drawing Sheets

SHOE HAVING CONVERTIBLE HEEL

CROSS REFERENCE TO RELATED APPLICATION

This application claims the benefit of U.S. App. No. 61/954,768, filed Mar. 18, 2014, which is incorporated by reference.

FIELD OF THE INVENTION

The present invention relates generally to high heel shoes and, more particularly, to shoes having a convertible heel.

BACKGROUND OF THE INVENTION

Present day women's fashion trends demand wearing high heels, often to the detriment of a woman's foot health. In most cases, women are willing to sacrifice comfort for fashion because they enjoy the style, confidence, additional height, and improved posture that a high heel shoe provides. High-fashion stiletto heels can be particularly uncomfortable because of the decreased surface area supporting a woman's weight, but women continue to wear them because their desire to be fashionable and sexy. A wider based heel can provide more comfort by offering a larger surface area to distribute a woman's weight. Moreover, such heels tend to be stylistically appropriate for daytime occasions, such as a day at the office.

A busy woman who goes from a day at the office to an evening of cocktails with clients or friends would have to carry two different types of shoes with her during the day. A busy, fashionable woman needs more options when it comes to high heels.

Others have attempted to address this problem by offering alternative solutions to high heels, such as a shoe with heels of various heights. This type of design presents another problem for the wearer, the need to adjust the hem of her garments to match the height of the shoe. A design with interchangeable heels presents the additional problem that the wearer has to carry extra heels around with her during the day.

It should, therefore, be appreciated there remains a need for a shoe that provides a convertible heel, in fashionable and convenient design. The present invention fulfills this need and others.

SUMMARY OF THE INVENTION

Briefly, and in general terms, by way of example and not limitation, the present invention is direct towards a shoe having a convertible heel. The shoe includes a sole having a stow cavity. Additionally, a first heel assembly and a second heel assembly that can transfer from a stowed position in the stow cavity to a deployed position. In the deployed position, the second heel assembly is below a heel portion of the sole such that the contact surface of the second heel assembly is positioned to contact the ground when worn, such that the shoe has a greater contact area with the second heel assembly in the deployed position.

More specifically, in an exemplary embodiment, a rotating mount is positioned above the first heel assembly and below the sole to rotate about a longitudinal axis. The second heel assembly includes a second heel body having an upper end that attaches to the rotating mount to allow the second heel assembly to rotate about the longitudinal axis. A locking mechanism is provided that releasably secures the second heel assembly in the deployed position.

In a detailed aspect of an exemplary embodiment, the first heel assembly includes a first heel body having an upper end that defines an axial bore and a bottom end that defines the contact surface thereof, the first heel body defines a longitudinal axis. A spacer is positioned atop the first heel body inhibited for axial rotation. A rotating mount is positioned above the first heel body and below the sole to rotate about the longitudinal axis with respect to the first heel body. A fastener extends through the rotating mount and the spacer that attaches the first heel body to the portion of the sole.

In another detailed aspect of an exemplary embodiment, the second heel body defines an axial recess that conforms about the first heel assembly, when in the deployed position.

In yet another detailed aspect of an exemplary embodiment, the second heel assembly, in the deployed position, provides a heel height that equals a heel height provided by the first heel assembly, when the second heel assembly is in the stowed position.

In yet another detailed aspect of an exemplary embodiment, the second heel assembly is positioned aft of the first heel assembly, when in the deployed position. Alternatively, in yet another detailed aspect of an exemplary embodiment, the second heel assembly is positioned forward of the first heel assembly, when in the deployed position.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
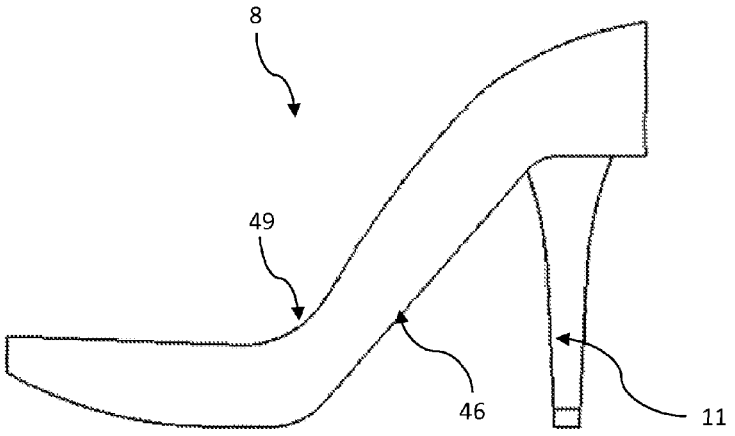
FIG. 1 is a side view of a shoe in accordance with the invention, depicting a first heel assembly (with a second heel assembly in a stowed position).
Figure 2:
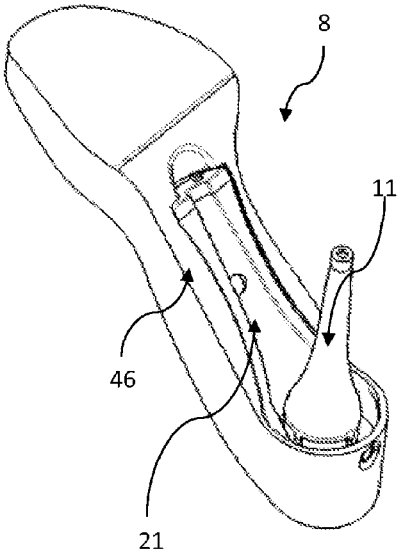
FIG. 2 is a bottom perspective view of the shoe of FIG. 1, depicting the second heel assembly in the stowed position.
Figure 3:
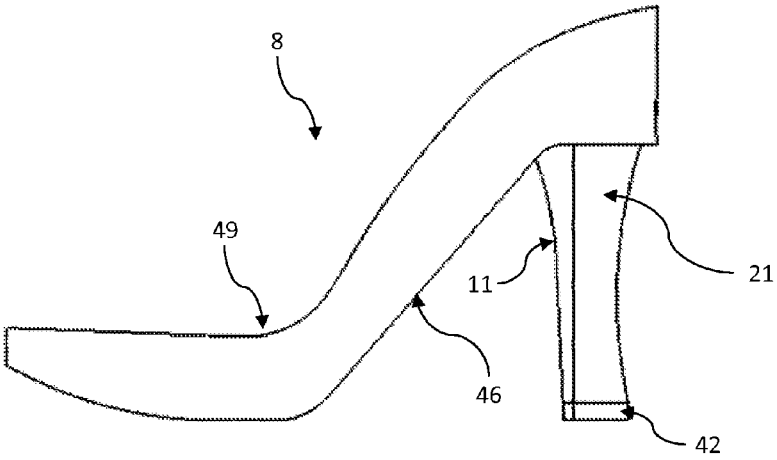
FIG. 3 is a side view of the shoe of FIG. 1, depicting the second heel assembly aft of the first heel assembly in a deployed position.
Figure 4:
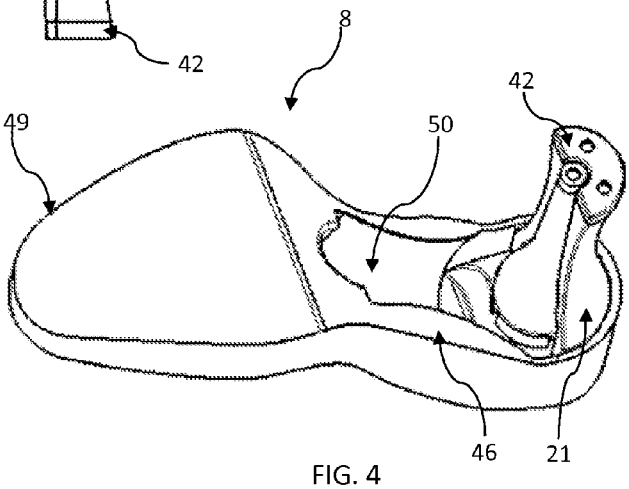
FIG. 4 is a bottom perspective view of the shoe of FIG. 1, depicting the second heel assembly aft of the first heel assembly in the deployed position.

Referring now to the drawings, and particularly FIGS. 1-4, there is shown a shoe 8 having a convertible heel. The shoe includes a sole 49 having a stow cavity 50, a first heel assembly 11 and a second heel assembly 21 that can transfer from a stowed position (see, e.g., FIGS. 1 and 2) in the stow cavity 50 to a deployed position (see, e.g., FIGS. 3 and 4). In the deployed position, the second heel assembly 21 is below a heel portion of the sole such that the contact surface of the second heel assembly is positioned to contact the ground when worn. Thus, the shoe has a greater contact surface area with the second heel assembly in the deployed position. Moreover, the shoe can convert from a first heel (e.g., stiletto heel) to a second heel design (e.g., spool heel).

In the exemplary embodiment, the second heel assembly 21, in the deployed position, provides a heel height that equals a heel height provided by the first heel assembly 11, when the second heel assembly 21 is in the stowed position.

Figure 5:
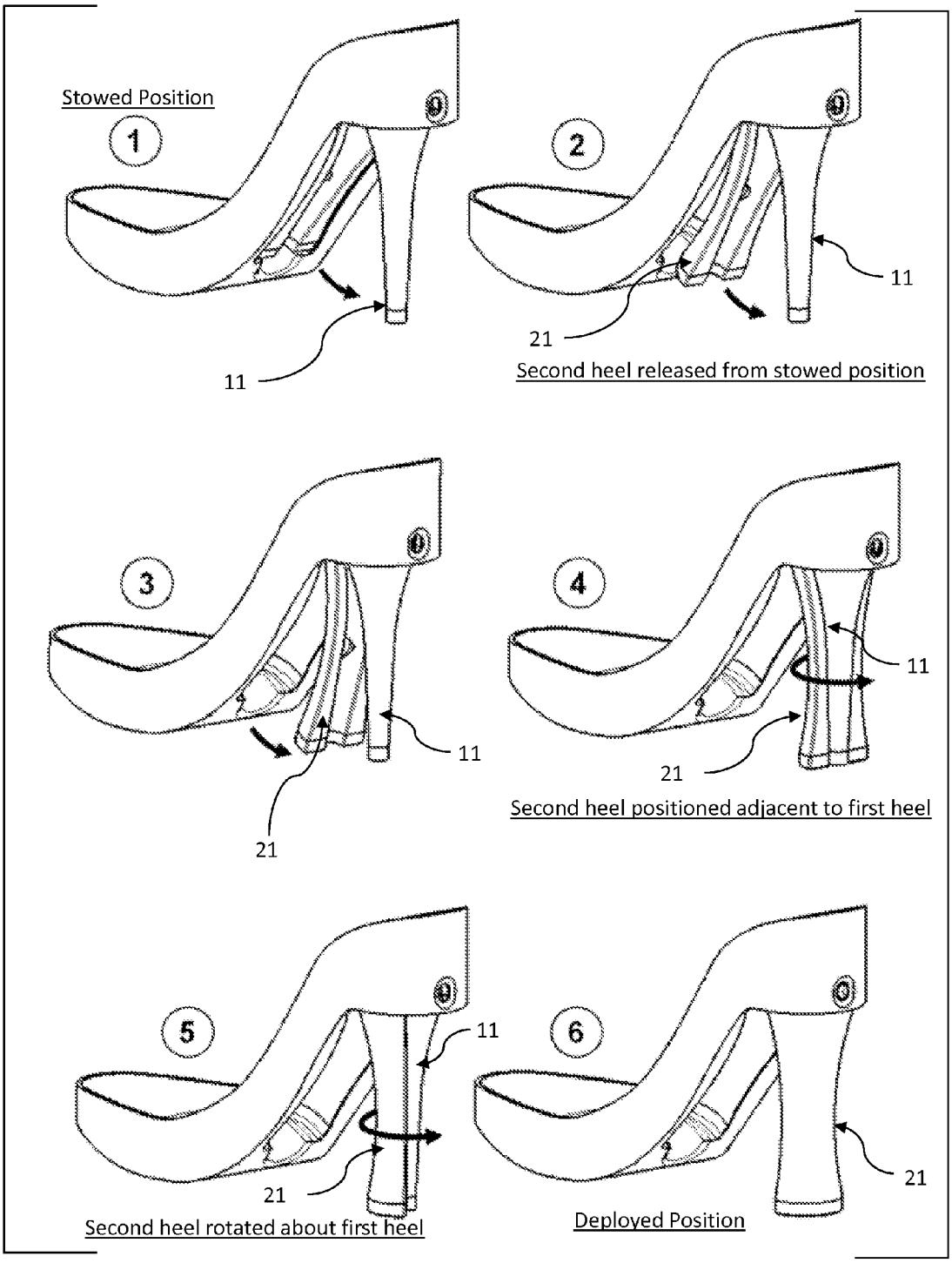
FIG. 5 is series of perspective views of the shoe of FIG. 1, which depict a transition of the second heel assembly from a stowed position to the deployed position.

With reference now to FIG. 5, exemplary steps are shown for transitioning the second heel assembly 21 from a stowed position to the deployed position. In the stowed position (step 1), the second heel assembly 21 is stowed in the stow cavity 50. In the stowed position, the second heel assembly 21 is secured in place so the wearer can use the shoe utilizing the first heel assembly 11. The second heel assembly 21 is secured in a manner so that it will stay in place, during normal use. In the exemplary embodiment, the second heel assembly 21 is maintained in place via magnetic attraction, as discussed in detail below. In steps 2-4, the second heel assembly 21 is released from the stow cavity 50 and positioned adjacent to the first heel assembly 11, in a forward position relative to the first heel assembly 11. At step 5, the second heel assembly 21 is rotated about a longitudinal axis ($A_L$), until the second heel assembly 21 is locked in place in an aft position relative to the first heel assembly 11 at the deployed position, step 6.

Figure 6:
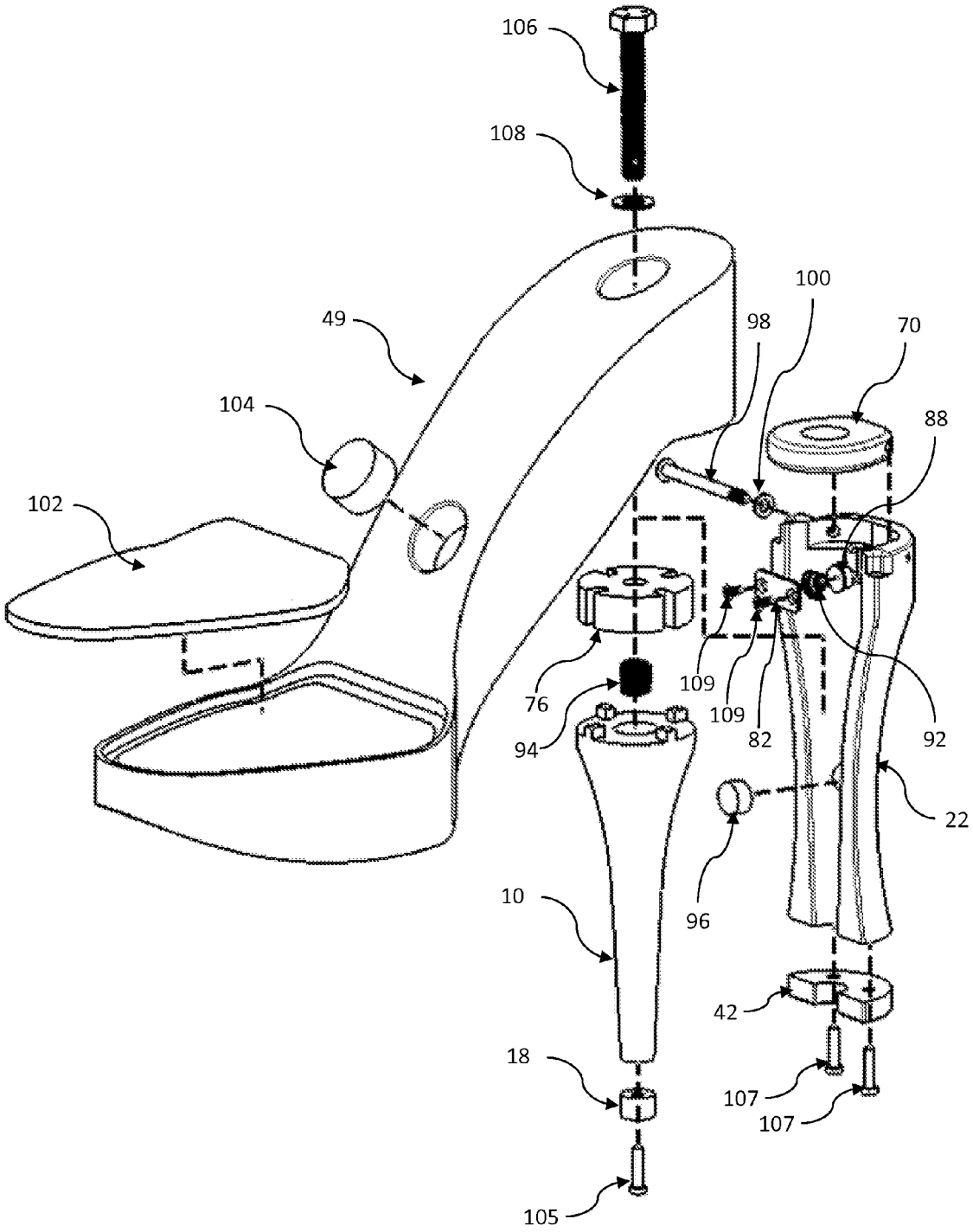
FIG. 6 is a partially exploded perspective view of the shoe of FIG. 1.
Figure 7:
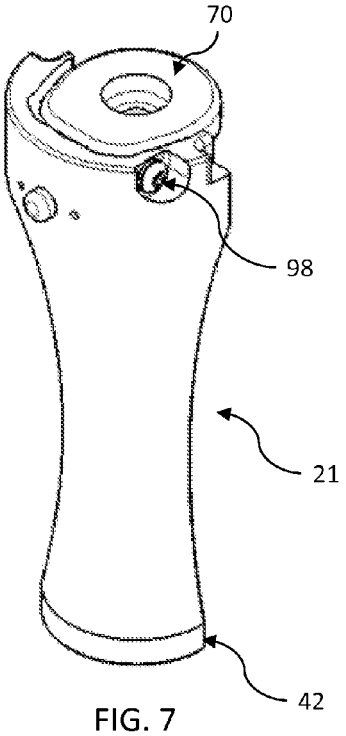
FIG. 7 is an isometric view of the second heel assembly of the shoe of FIG. 1.
Figure 8:
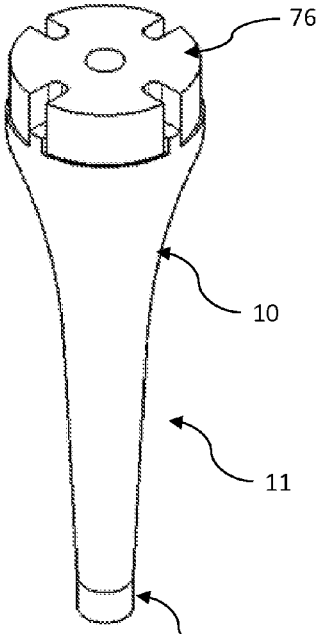
FIG. 8 is an isometric view of the first heel assembly of the shoe of FIG. 1.

With reference now to FIG. 6, an exploded view of the shoe 8 is shown. The shoe includes the sole body 49, the first heel assembly 11, and the second heel assembly 21. The sole body includes a toe portion 58, a heel portion 61, and a shank 46 therebetween that defines a stow cavity 50. The sole further includes cover 102 in the toe portion. A magnet 104 is provided proximate in the shank to magnetically attract the corresponding magnet 96 of the second heel assembly when stowed. Additionally, fastener 106 and washer 108 for securing the first heel assembly 11 (FIG. 8) and second heel assembly 21 (FIG. 7).

Figure 9:
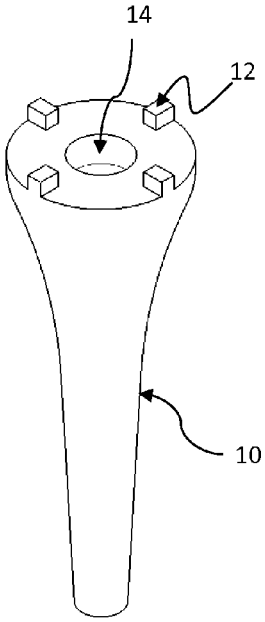
FIG. 9 is an isometric view of the first heel body of the shoe of FIG. 1.
Figure 12:
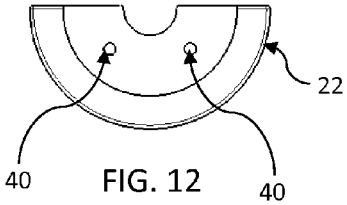
FIG. 12 is a bottom view of the second heel body of the shoe of FIG. 1.

With reference to FIGS. 6 and 9, the first heel assembly 11 includes a first heel body 10 having a stiletto heel profile, which increases in diameter with respect to length from ground up. The upper end of the first heel body 10 defines an axial bore 14, aligned with a longitudinal axis ($A_L$) thereof, that receives fastener 106 and washer 108 for securing the first heel assembly 11 to the sole body, more specifically within a seat 60 in the heel portion 61. A screw-locking helicoil insert 94 is installed atop, into the axial bore 14, which provides permanent high strength capabilities.

Figure 10:
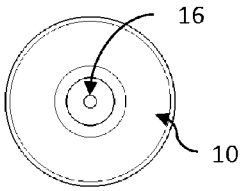
FIG. 10 is a bottom view of the first heel body of the shoe of FIG. 1.
Figure 13:
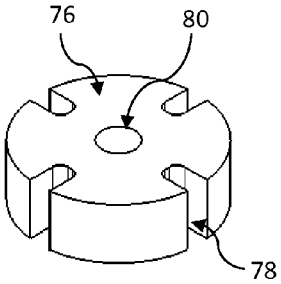
FIG. 13 is an isometric view of the spacer of the shoe of FIG. 1.
Figure 14:
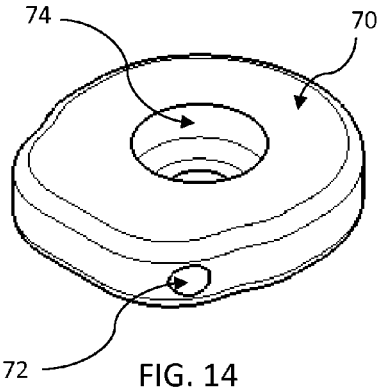
FIG. 14 is an isometric view of the rotating mount of the shoe of FIG. 1.

With reference now to FIGS. 6 and 10, the first heel assembly 11 includes a contact surface for contacting the ground when worn. In the exemplary embodiment, an annulus shaped top piece 18 is disposed at the bottom of the heel body 10. A blind tapped hole 16 at the base of the heel body 10 is used to secure the top piece 18 via a counterbore through hole 20 using fastener 105.

As best seen in FIGS. 6, 8-9, and 13, a spacer 76 positioned atop the first heel body inhibited for axial rotation. More particularly, the top of the heel body 10 includes a plurality of key 12 that mate with keyways 78 of the spacer to inhibit rotation of the spacer about the longitudinal axis ($A_L$). In the exemplary embodiment, four keys 12 are used, spaced 90 degrees apart about the top end, with four keyways 78 in corresponding alignment. The spacer includes a concentric through hole 80 which the fastener 106 extends through to connect to the axial bore 14 of the first heel body 10.

With reference to FIG. 6, a rotating mount 70 is positioned above the first heel body 10 and below the sole 49 with respect to the seat 60 to rotate about the longitudinal axis ($A_L$). The rotating mount 70 is disposed above and adjacent to the spacer 76. The spacer 76 and the rotating mount 70 are correspondingly configured so that the rotating mount can rotate relative to the spacer. The fastener 106 extends through the rotating mount counterbore 74 and the spacer through hole 80 that attaches the first heel body assembly 11 to the seat 60 of the sole body 49.

With reference to FIGS. 6-7 and 11-12, the second heel assembly 21 includes a second heel body 22 that is attached to the rotating mount 70 via a fastener 98 and washer 100. The second heel body 22 has a spool heel profile and defines an axial recess 24 that conforms to the first heel assembly 11, when in the deployed position. A disk magnet 96 is disposed in the hole 38 of the second heel body 22, which is aligned to interact with a corresponding magnet 104 of the sole, when in the stowed position. Two blind tapped holes 40 at the base of the heel body 22 are used to secure the half-annulus shaped top piece 42 via two counterbore through holes 44 using fastener 107.

With reference to FIGS. 7 and 14-16, the fastener 98 connects the second heel body 22 to the rotating mount 70. More particularly, the fastener extends through hole 32 and 34 (FIGS. 15 and 16) defined in an upper end of the second heel body 22, and through hole 72 of the rotating mount.

Figure 17:
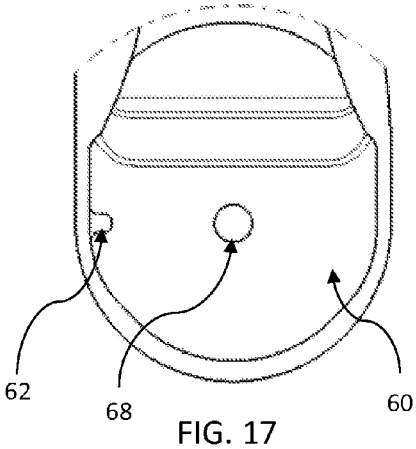
FIG. 17 is a detailed bottom view of the seat of the shoe of FIG. 1, depicting a stop at the perimeter that interacts with the second heel body.
Figure 15:
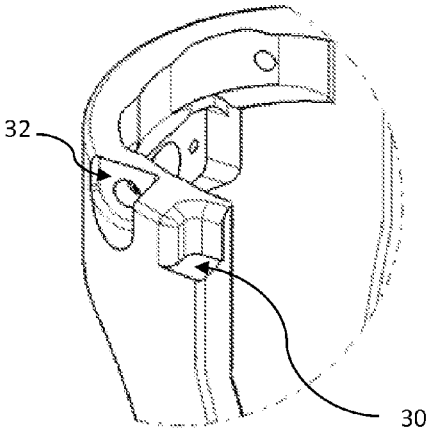
FIG. 15 is a detailed perspective view of one side of the upper end of the second heel body of the shoe of FIG. 1.
Figure 18:
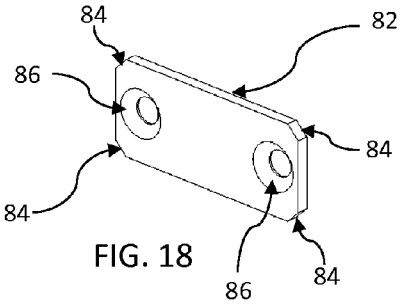
FIG. 18 is a perspective view of the plate of the shoe of FIG. 1.
Figure 19:
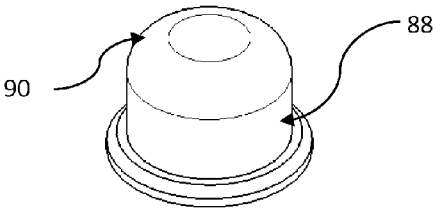
FIG. 19 is a perspective view of the shoulder pin of the shoe of FIG. 1 and FIG. 27.
Figure 16:
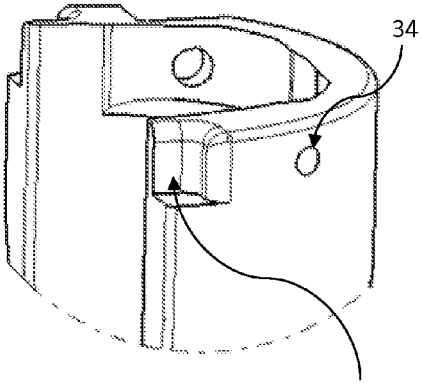
FIG. 16 is a detailed perspective view of the opposing side of the upper end of the second heel body of the shoe of FIG. 1.
Figure 20:
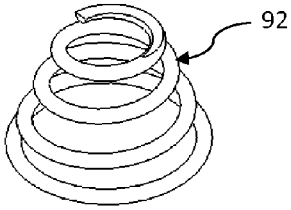
FIG. 20 is a perspective view of a tapered conical compression spring of the shoe of FIG. 1 and FIG. 27.

As best seen in FIG. 17, the seat 60 includes an integrated adjacent stop 62, which stops the second heel assembly 21 from rotating further by interacting with catch recesses 30 (FIGS. 15 and 16) in the upper end of the second heel body 22. A through hole 68 is defined in the seat 60. The hole 68 is aligned with the corresponding axial blind counterbore hole 14 of the first heel body, so the fastener 106 can connect therethrough.

Figure 21:
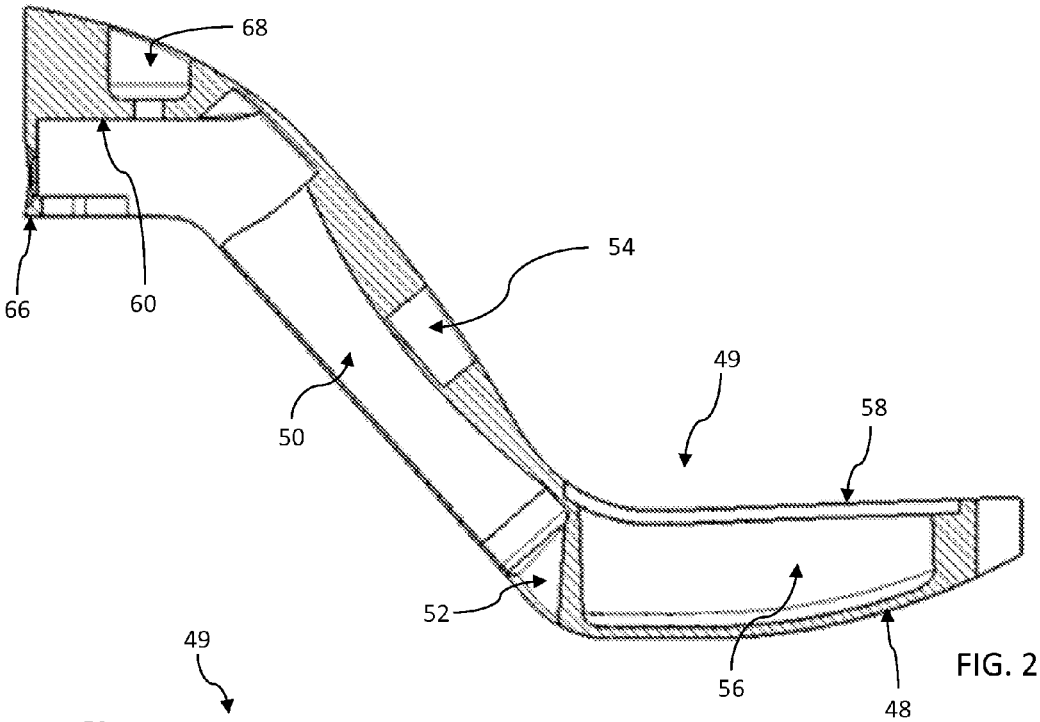
FIG. 21 is a cross-sectional view of the sole of the shoe of FIG. 1.
Figure 22:
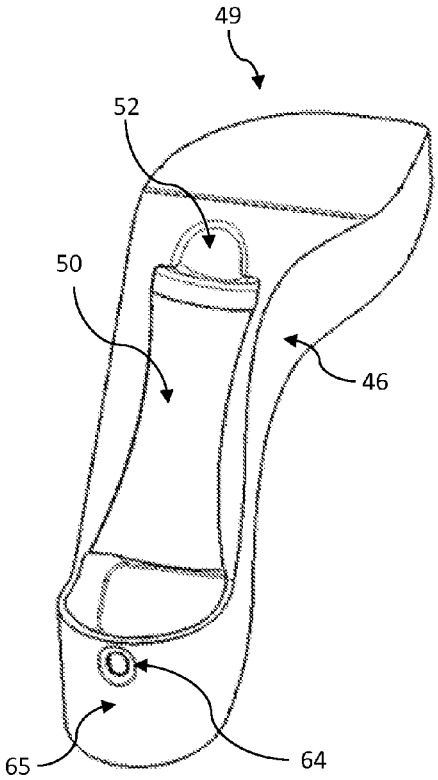
FIG. 22 is a bottom perspective view of the sole of the shoe of FIG. 1.
Figure 24:
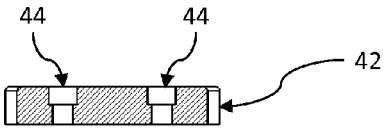
FIG. 24 is a cross-sectional view of the top piece of the second heel body of the shoe of FIG. 1 taken along line 1-1 of FIG. 23.
Figure 23:
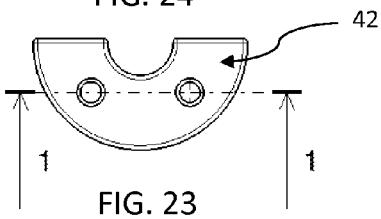
FIG. 23 is a bottom view of the top piece of the second heel body of the shoe of FIG. 1.
Figure 26:
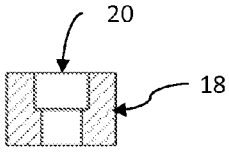
FIG. 26 is a cross-sectional view of the top piece of the first heel body of the shoe of FIG. 1 taken along line-2-2 of FIG. 25.
Figure 25:
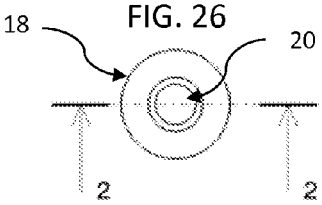
FIG. 25 is a bottom view of the top piece of the first heel body of the shoe of FIG. 1.

With reference now to FIGS. 21-22, the sole body 49 includes a thick shoe shank flange 46 to support the foot and provide stiffness to the shoe and an outsole 48 which contacts the ground to support the foot and provide stiffness to the shoe. The stow cavity 50 having a discrete corresponding second heel assembly 21 profile to stow the second heel assembly 21 is defined in the shoe shank. Additionally, the cavity includes an integrated ergonomic recessed feature 52 for quick release of the second heel assembly 21. An upper surface of the sole defines a hole 54 aligned with the second heel assembly 21 when stowed. The hole 54 retains magnet 104 to magnetically attract the corresponding magnet 96 of the second heel assembly. Additionally, an open cavity 56 in the toe portion 58 is provided to decrease weight. The heel portion of the sole defines a seat 60 that receives the heel assemblies 11, 21. The flange counter 65 includes a vertical slot 64 and an integrated semi-annulus shaped pad 66, which prevents displacement of the second heel assembly 21 and provides additional stiffness.

With reference now to FIGS. 5 and 18-20, the second heel assembly 21 includes a locking mechanism (spring-shoulder pin assembly) that releasably secures the second heel assembly in the deployed position. The spring-shoulder pin assembly includes (a) the plate 82 that defines four chamfers 84 and two countersink holes 86, (b) the shoulder pin 88 with an apex bullnose 90, and (c) the tapered conical compression spring 92.

Figure 11:
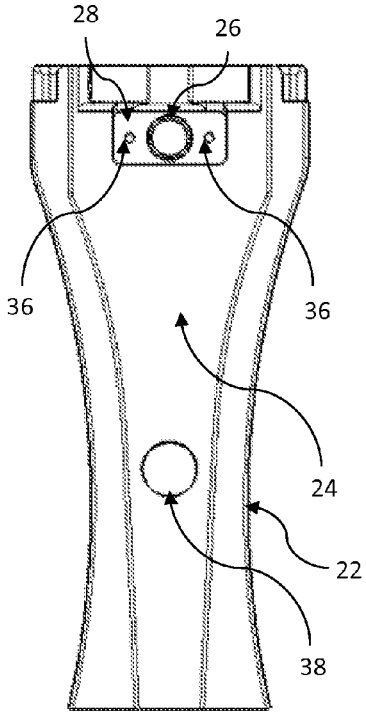
FIG. 11 is a front view of the second heel body of the shoe of FIG. 1.

With reference to FIGS. 5-6 and 11 the shoulder pin 88 biased to projected through a vertical slot 64 defined in the counter 65 (heel portion) of the sole body 49. The conical compression spring 92 is positioned between the shoulder pin 88 and a plate 82. The counterbore through hole 26 defined by second heel body 22 secures the shoulder pin. The plate 82 is attached to the second heel body 22 confined rectangular pocket 28 via two countersink fasteners 109 to the two blind tapped holes 36 of the second heel body 22.

The second heel assembly 21 is inhibited from rotating by the locking mechanism. To release, the second heel assembly 21 from the deployed position, the user depresses the shoulder pin 88 and rotates the second heel assembly 21 about the longitudinal axis ($A_L$). More particularly, the user applies a normal force to the shoulder pin 88 beyond the shoe counter 65 flange thickness to release the second heel assembly 21, allowing it to rotate with respect to the first heel assembly 11 to a stop 62. Subsequently, the user then pivots the second heel assembly 21 with respect to the fastener 98 to stow, where it is fixed by means of the force exerted by the magnets 96 and 104.

More particularly, to release from the stowed position, the user applies a perpendicular shear force greater than and opposite to the force exerted by the magnets to the top piece 42 of the second heel assembly 21 by means of the integrated ergonomic recessed feature 52. Accordingly, the user then pivots the second heel assembly 21 and subsequently rotates it with respect to the fastener 98 and the first heel assembly 11, respectively to a stop 62, where concurrently the shoulder pin 88 engages the vertical slot 64 of the counter 65 to lock the second heel assembly 21 and be used in conjunction with the first heel assembly 11 when additional comfort is required, as depicted in FIG. 5. This unique architecture mitigates the risk of the second heel assembly 21 rotating or moving when locked in place since the shoulder pin 88 must be pressed beyond the shoe counter 65 flange thickness, making the architecture fail-safe. Moreover, all hardware is self-contained, including the first heel assembly 11, which is permanently attached with respect to the seat 60 of the sole body 49 by means of fastener 106, washer 108, and screw-locking helicoil insert 94. Consequently, the user is always balanced and less susceptible to injury, an intentional design attribute. Therefore, if the pin 88 is accidently pressed or pushed up against, the architecture still prevails. Additionally, the tight fit that exists between the shoulder pin 88 and the counter vertical slot 64 further prevents the second heel assembly 21 from moving, transferring all mechanical pin shear stresses directly to the shoe counter 65. This strategic design results in a solid structure.

The mechanism, described in the foregoing paragraphs which allows the second heel assembly 21 to readily and effortlessly rotate with respect to the first heel assembly 11 at the user's discretion, allows the second heel assembly 21 to be used in conjunction with the first heel assembly 11, or to be concealed and used alone as a first heel assembly 11 are the key design attributes of the preferred embodiment that allows this mechanism to function.

Figure 27:
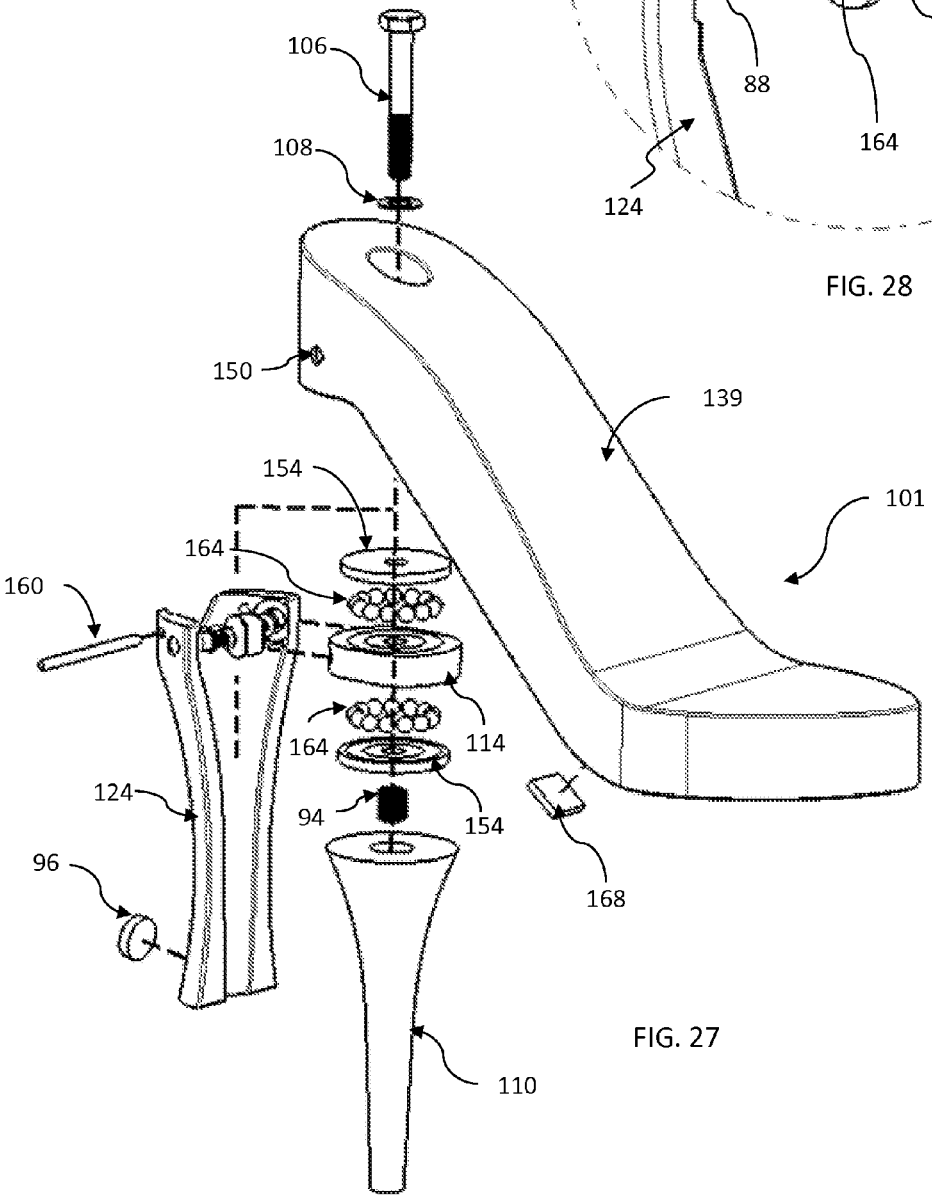
FIG. 27 is a partially exploded perspective view of a second embodiment of a shoe in accordance with the invention.
Figure 29:
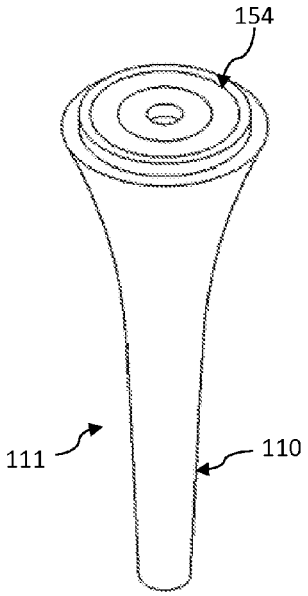
FIG. 29 is an isometric view of the first heel assembly of the shoe of FIG. 27.
Figure 31:
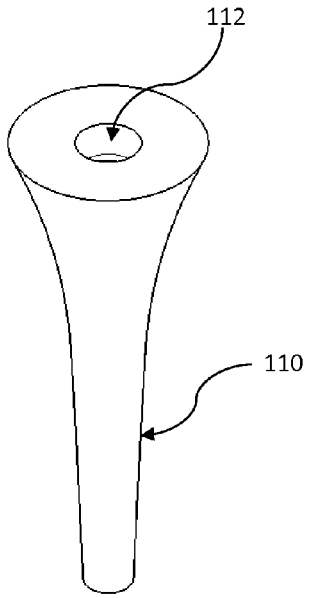
FIG. 31 is an isometric view of the first heel body.

With reference now to FIGS. 27 and 31, another embodiment of a shoe 101 is shown, having a first heel body 110, a second heel body 124, and a sole 139 body. The first heel body 110 increases in diameter with respect to length from ground up with a concentric blind tapped counterbore hole 112 atop the first heel body.

Figure 34:
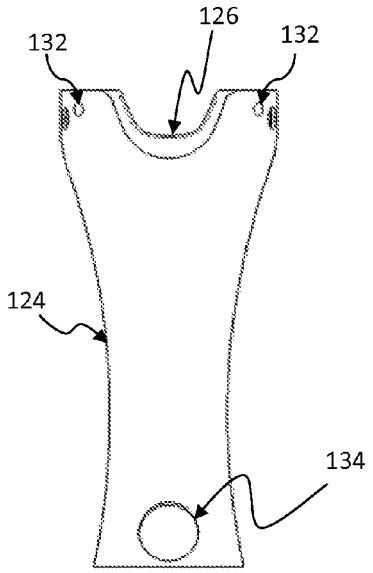
FIG. 34 is a back side view of the second heel body of the shoe of FIG. 27.
Figure 30:
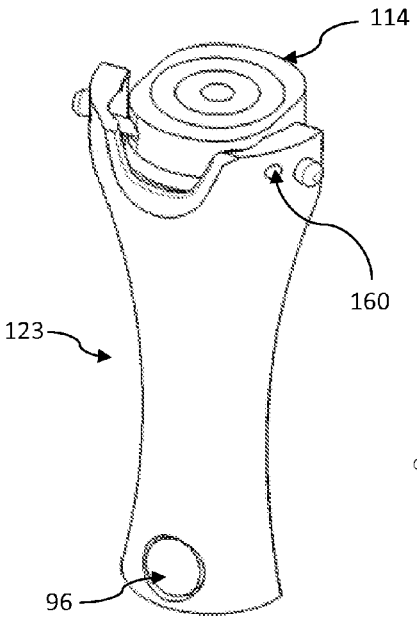
FIG. 30 is a perspective view of the second heel assembly of the shoe of FIG. 27.
Figure 32:
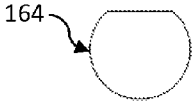
FIG. 32 is a front view of the flat plate of the shoe of FIG. 27.
Figure 35:
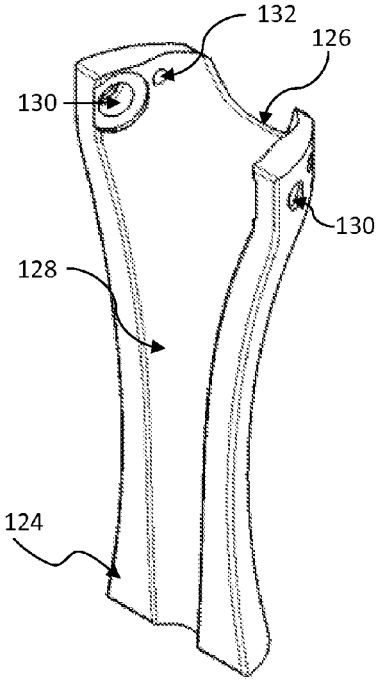
FIG. 35 is a perspective view of a second heel body of the shoe of FIG. 27.

With reference to FIGS. 30 and 34-35 the second heel 124 provides a through obtuse-u-cut 126 shaped near the top for clearance to the flat annulus shaped spacer 114. The second heel body also defines a stiletto heel body profile 128 through the central axis. Additionally, two counterbore through holes 130, which exist at two distinct lines of action, a through hole 132, and a blind hole 134 near the bottom of the heel.

Figure 36:
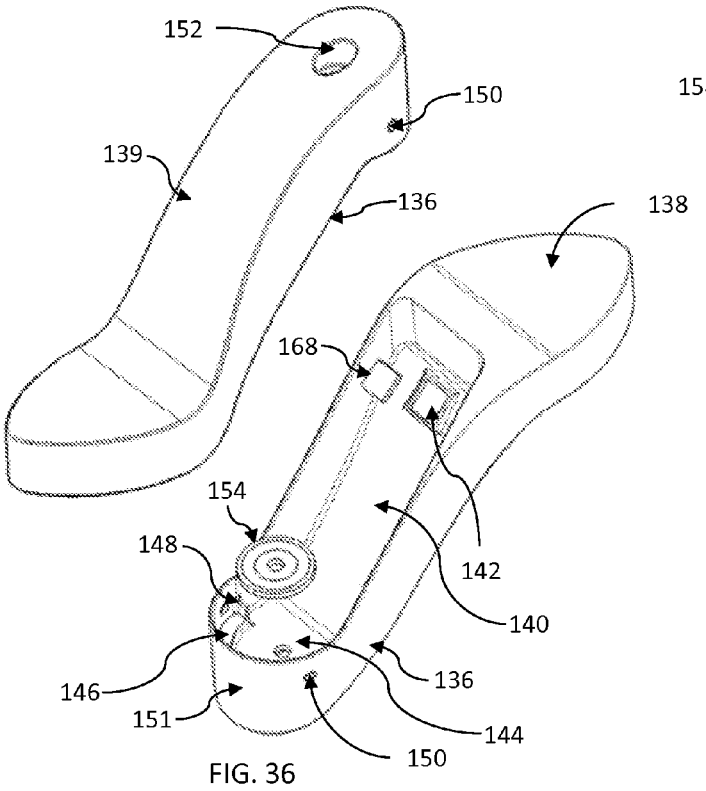
FIG. 36 is a top and bottom perspective view of the sole of the shoe of FIG. 27 in accordance with the invention, depicting the sub-components included with the sole assembly.
Figure 40:
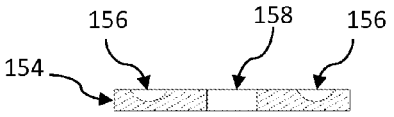
FIG. 40 is a cross-sectional view of the fix spacer of the shoe of FIG. 27 taken along line 4-4 of FIG. 39.
Figure 39:
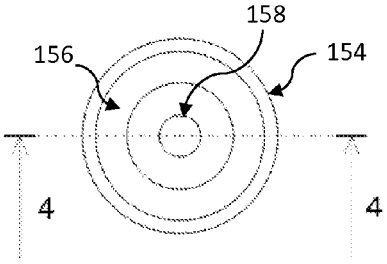
FIG. 39 is a top view of the fix spacer of the shoe of FIG. 27.

As best seen in FIG. 36, the sole 139 body has a thick shoe shank flange 136 to support the foot and provide stiffness to the shoe and an outsole 138 which contacts the ground. A stow cavity 140, is used to stow the second heel assembly 123 with a small integrated pocket 142, designed to be parallel with the second heel assembly 123 when stowed.

With reference to FIGS. 27 and 36, the seat 144 supports both the first 111 and second 123 heel assemblies. The seat also includes an integrated semi-annulus shaped pad 146 at the perimeter for vertical supporting load purposes and a vertical adjacent stop 148 at the edge of the semi-annulus shaped pad 146, which stops the second heel assembly 123 from rotating further. Two through holes 150 lie on each side of the shoe counter 151 on distinct lines of actions. A counterbore through hole 152 opposite the seat 144 secures the first heel assembly 111.

Figure 33:
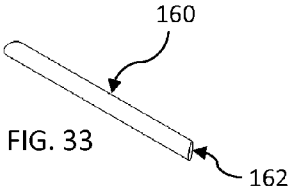
FIG. 33 is an isometric view of the rod of the shoe of FIG. 27.

As best seen in FIGS. 27, 30, and 38-40, the shoe further includes a mechanism that allows the second heel assembly 123 to rotate and pivot with respect to the seat 144. This mechanism comprises (a) a flat annulus shaped spacer 114 less two circular segments 116 with a bearing annular groove 118 on either side, a through hole 120, and a concentric through hole 122, (b) a flat annulus shaped fixed spacer 154 with a bearing annular groove 156 and a concentric through hole 158, (c) a rod 160 with angle cuts 162 at each end (see FIG. 33), and (d) ball bearings 164. A rod 160 is used to attach the flat annulus shaped spacer 114 to the second heel body 124 by means of an interference fit with respect to through hole 132 of the second heel body 124.

Figure 28:
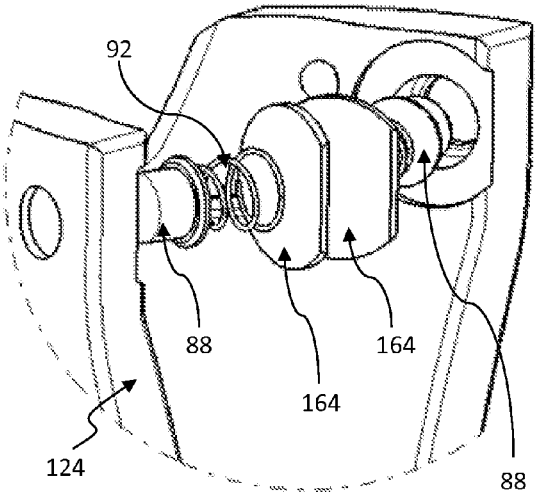
FIG. 28 is a detailed exploded view of FIG. 27, more specifically of the spring-shoulder pin assembly of the shoe.

As best seen in FIG. 28, the second heel assembly 123 includes two spring-shoulder pin assemblies each having (a) a flat plate 164, (b) a shoulder pin 88, and a (c) tapered conical compression spring 92 disposed between the plate and the shoulder pin. The shoulder pin assemblies are installed in each counterbore through hole 130 and subsequently a flat plate 164 is epoxied to each counterbore through hole 130.

Figure 42:
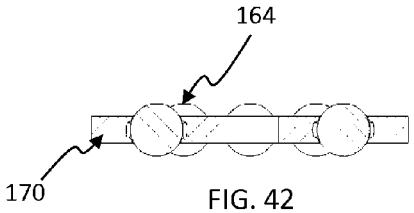
FIG. 42 is a cross-sectional view of a ball bearing retainer.
Figure 37:
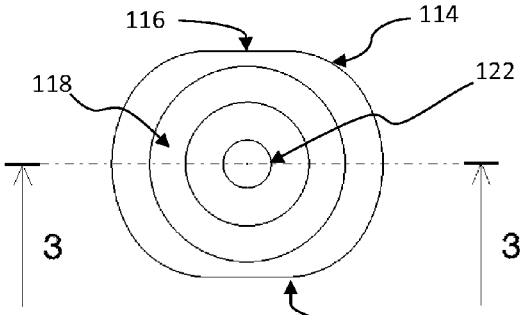
FIG. 37 is a top view of the spacer of the shoe of FIG. 27.

With reference to FIGS. 27, 29-30, and 34-40, the sole 139 body includes a magnet 168 with opposite polarity than the foregoing epoxied disk magnet 96. Additionally, a flat annulus shaped fixed spacer 154 is attached, e.g., via epoxy or similar, to the seat 144 concentric to the counterbore through hole 152. The first heel assembly 111 includes a screw-locking helicoil insert 94, installed atop the first heel body 110 blind tapped counterbore hole 112 for permanent high strength capabilities. A flat annulus shaped fixed spacer 154 attached, e.g., via epoxy or similar, to the apex of the first heel body 110. The second heel assembly 123 includes a disk magnet 96 disposed into a bottom blind hole 134. Ball bearings 164 are disposed into the annular groove(s) 118 and 156. It should be noted that the ball bearings 164 described herein can also be captivated using a nylon or similar retainer 170 (see FIG. 42).

In use, the shoe 101 operates similarly to the first embodiment. To release the second heel from the deployed position, the user concurrently depresses the two shoulder pins 88 beyond the shoe counter 151 flange thickness, allowing it to rotate with respect to the first heel assembly 111 to a stop 148. Subsequently, the user then pivots the second heel assembly 123 with respect to the interference fit rod 160 to the stowed position, where it is fixed by means of the force exerted by the magnets 96 and 168.

To release from the stowed position, the user applies a shear force greater than and opposite to the force exerted by the magnets to the base of the second heel assembly 123. Accordingly, the user then pivots the second assembly 123 and subsequently rotates it with respect to the interference rod 160 and the first heel assembly 111, respectively to a stop 148. The shoulder pins 88 engage the through holes 150 of the shoe counter 151 to lock the second heel assembly 123 in the deployed position. In the deployed position, the second heel is used in conjunction with the first heel assembly 111.

It should be appreciated that the unique architecture mitigates the risk of the second heel assembly 123 rotating or moving when locked in place since both shoulder pins 88 must be pressed concurrently beyond the shoe counter 151 flange thickness, making the architecture fail-safe. Moreover, all hardware is self-contained, including the first heel assembly 111, which is permanently attached with respect to the seat 144 of the sole 139 body by means of fastener 106, washer 108, and a screw-locking helicoil insert 94. Consequently, the user is always balanced and less susceptible to injury, an intentional design attribute. Therefore, if the pins 88 are accidently pressed or pushed up against, the architecture still prevails. Additionally, the tight fit that exists between the shoulder pins 88 and the shoe counter 151 through holes 150 further prevents the second heel assembly 123 from moving, transferring all mechanical pin shear stresses directly to the shoe counter 151. This strategic design results in a solid structure.

The mechanism, described in the foregoing paragraphs which allows the second heel assembly 123 to readily and effortlessly rotate with respect to the first heel assembly 111 at the user's discretion, allow the second heel assembly 123 to be used in conjunction with the first heel assembly 111 or to be concealed and used alone as a first heel assembly 111 are the key design attributes of the alternative embodiment that allows this mechanism to function. The ball bearings 164 significantly reduce friction and greatly support radial (vertical) load, while decreasing mechanical stresses throughout the shoe and allowing for this movement to occur.

Figure 41:
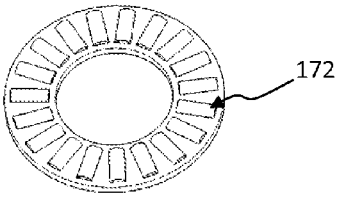
FIG. 41 is a perspective view of needle bearings retained.
Figure 38:
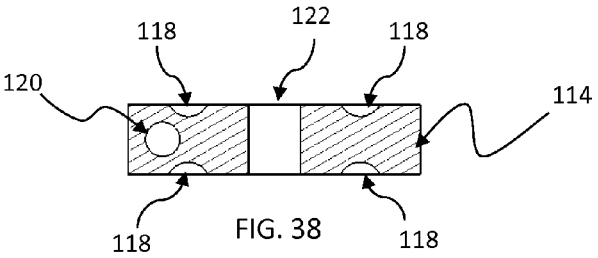
FIG. 38 is a cross-sectional view of the spacer of the shoe of FIG. 27 taken along line 3-3 of FIG. 37.

Various additional alternatives to the aforementioned embodiment exist for stowing and deploying the second heel assembly 123. For example, several alternative mechanical systems may be used in lieu of ball bearings to rotate the second heel assembly 123 with respect to the first heel assembly 111 with minimal changes to the scope of the design. As an alternative, captivated needle bearings 172 may be used (see FIG. 41).

Figure 44:
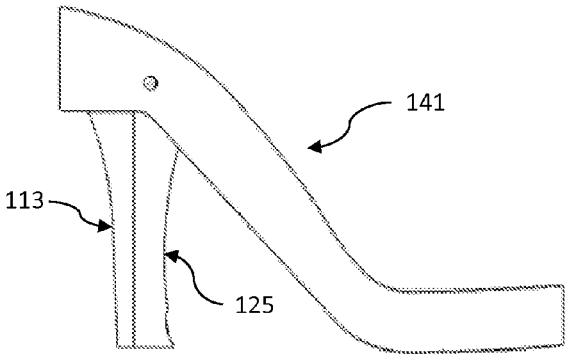
FIG. 44 is a side view of another embodiment in accordance with the invention, depicting the second heel assembly forward of the first heel assembly in the deployed position.

In other embodiments, the second heel assembly 125 can be fixed forward of the first heel assembly 113 with respect to the shoe 141, as illustrated in FIG. 44.

Figure 45:
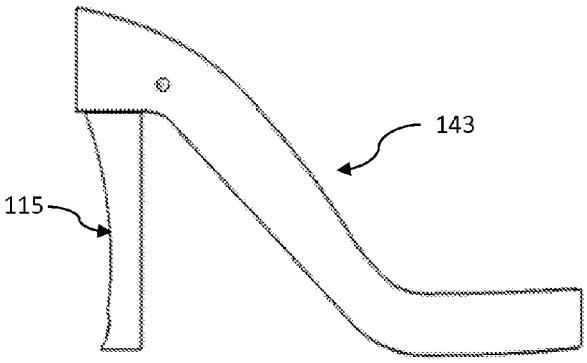
FIG. 45 is a side view of yet another embodiment in accordance with the invention, depicting the first heel assembly having a spool heel body configuration.
Figure 46:
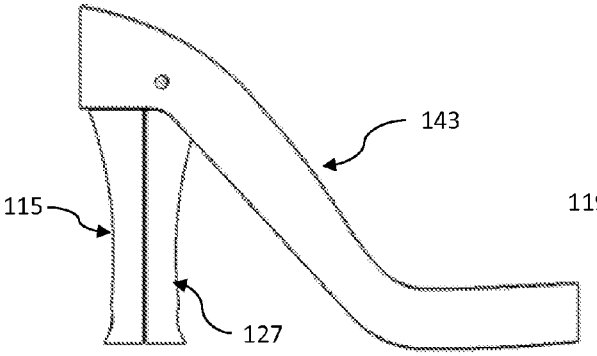
FIG. 46 is a side view of the shoe of FIG. 45, depicting the second heel assembly forward of the first heel assembly in the deployed position having a spool heel body configuration.

In yet another embodiment to further increase the overall surface area of the shoe 143, the first heel assembly 115 can have a spool heel profile (e.g., FIG. 45) and be used in conjunction with a second spool heel profile assembly 127 in the deployed position, depicted in FIG. 46. Thereby, significantly increasing the contact surface area of the shoe with respect to the ground.

Figure 43:
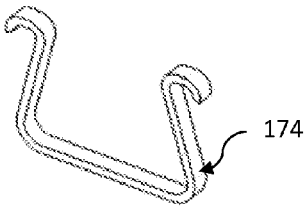
FIG. 43 is an isometric view of the detent spring used to secure the second heel assembly of the shoe of FIG. 48.
Figure 47:
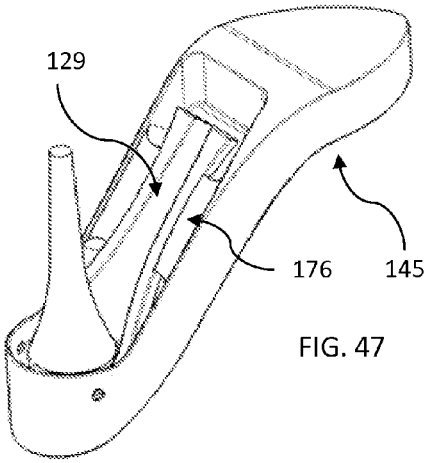
FIG. 47 is a bottom perspective view of yet another embodiment in accordance with the invention, depicting the second heel assembly swaged in the stowed position.
Figure 48:
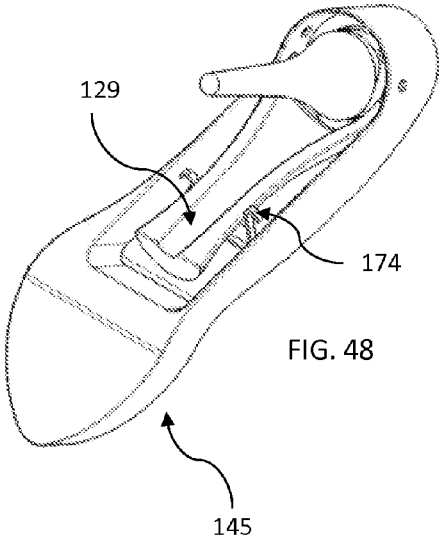
FIG. 48 is a bottom perspective view of the shoe of FIG. 47, depicting the second heel assembly secured in the stowed position via a detent spring.

In yet another embodiment, when stowing, the second heel assembly 129 can be swaged 176 directly to the shoe 145, or retained using a detent spring 174 (see FIG. 43) or similar, as depicted in FIGS. 47 and 48, respectively.

Figure 49:
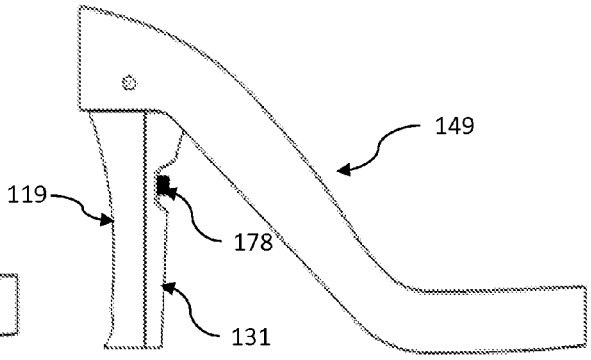
FIG. 49 is a side view of yet another embodiment in accordance with the invention, depicting the second heel assembly secured to the first heel assembly via a captive fastener in the deployed position.

In yet another embodiment for an exclusive look, a captive screw 178 or similar can be used to secure the second heel assembly 119 directly to the first heel assembly 131 with respect to the shoe 149, depicted in FIG. 49. This distinct approach also provides additional security for a more structurally sound design. Note this option is also feasible with any of the embodiments described herein.

All detailed components materials described herein can include but are not limited to wood, metal, plastic, steel, and rubber. Correspondingly, manufacturing processes of all detail components can include but are not limited to; casting, molding, rolling, machining, joining, and additive manufacturing.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A shoe, comprising:

a sole having an outsole, a seat, and a shank portion therebetween, the shank portion defines a stow cavity in the shank portion thereof;

a fixed first heel assembly having an upper end attached to the seat of the sole and having a contact surface at a base thereof positioned to contact the ground, such that the first heel assembly remains in a fixed orientation relation to the heel portion; and a second movable heel assembly having a contact surface at a base thereof, the second heel assembly having an upper portion that is pivotally coupled to a rotating mount to transfer between a stowed location in the stow cavity and a deployed location, with respect to the seat of the sole, proximate to the first heel assembly such that the contact surface area of the second heel assembly is positioned to contact the ground when worn, such that the shoe has a greater contact surface area with the second heel assembly in the deployed position.

2. The shoe as defined in claim 1, wherein the rotating mount is disposed about a longitudinal axis of the first heel assembly at the seat of the sole, the upper portion of the second heel assembly is attached to the rotating mount such that the heel assembly can rotate about the longitudinal axis of the first heel assembly and can pivot into the stowed position.

3. The shoe as defined in claim 2, wherein the rotating mount includes a plurality of bearings to facilitate rotation about the longitudinal axis.

4. The shoe as defined in claim 1, wherein, in the deployed position, the second heel assembly is positioned forward of the first heel assembly in the deployed position.

5. The shoe as defined in claim 1, wherein, in the deployed position, the second heel assembly is positioned aft of the first heel assembly in the deployed position.

6. The shoe as defined in claim 1, wherein the second movable heel assembly, in the deployed position, provides a heel height that equals a heel height provided by the first heel assembly, when the second heel assembly is in the stowed position, wherein both the first heel assembly and the second heel assembly contact the ground and contribute to the contact surface area of the shoe, when worn, with the second heel assembly in the deployed position.

7. The shoe as defined in claim 1, wherein the first heel assembly has a stiletto profile and the second heel assembly has a spool heel profile.

8. A shoe, comprising:

a sole having a toe portion, a heel portion, and a shank portion therebetween, the sole defines a stow cavity in the shank portion thereof;

a fixed first heel assembly having an upper end attached to the heel portion of the sole and having a contact surface at a base thereof positioned to contact the ground when worn, such that the first heel assembly remains in a fixed orientation relative to the heel portion; and a second heel assembly having contact surface at a base, the second heel assembly having an upper portion that is pivotally coupled to the heel portion of the sole to transfer between a stowed position in the stow cavity and a deployed position, below the heel portion of the sole, proximate to the first heel assembly such that the contact surface area of the second heel assembly is positioned to contact the ground when worn, such that the shoe has a greater contact surface area with the second heel assembly in the deployed position;

wherein the first heel assembly includes:

a first heel body having an upper end that defines an axial bore and a bottom end that defines the contact surface thereof, the first heel body defines a longitudinal axis;

a spacer positioned atop the first heel body inhibited for axial rotation;

a rotating mount positioned above the first heel body and below the sole to rotate about the longitudinal axis, and a fastener that extends through the rotating mount and spacer that attaches the first heel body to the heel portion of the sole.

9. The shoe as defined in claim 8, wherein the upper portion of the second heel assembly is attached to the rotating mount such that the heel assembly can rotate about the longitudinal axis of the first heel assembly and can pivot into the stowed position.

10. The shoe as defined in claim 8, further comprising a first locking mechanism that releasably secures the second heel assembly in the deployed position.

11. The shoe as defined in claim 8, further comprising a second locking mechanism that releasably secures the second heel assembly in the stowed position.

12. The shoe as defined in claim 8, wherein the second heel assembly defines an axial recess that conforms about the first heel assembly, when in the deployed position.

13. The shoe as defined in claim 8, wherein the first heel assembly has a stiletto profile and the second heel assembly has a spool heel profile.

14. The shoe as defined in claim 8, wherein the second heel assembly includes:

a second heel body having an upper end that attaches to the rotating mount and a bottom end that defines the contact surface thereof, and a first locking mechanism that releasably secures the second heel assembly in the deployed position.

15. A shoe, comprising:

a sole having an outsole, a seat, and a shank portion therebetween, the shank portion defines a stow cavity in the shank portion thereof;

a fixed first heel assembly having an upper end attached to the seat of the sole and having a contact surface at a base thereof positioned to contact the ground, such that the first heel assembly remains in a fixed orientation relative to the heel portion; and a second movable heel assembly having a contact surface at a base thereof, the second heel assembly having an upper portion that is pivotally coupled to a rotating mount to transfer between a stowed location in the stow cavity and a deployed location, with respect to the seat of the sole, proximate to the first heel assembly such that the contact surface area of the second heel assembly is positioned to contact the ground when worn, such that the shoe has a greater contact surface area with the second heel assembly in the deployed position;

wherein the second heel assembly, in the deployed position, provides a heel height that equals a heel height provided by the first heel assembly, when the second heel assembly is in the stowed position, wherein both the first heel assembly and the second heel assembly contact the ground and contribute to the contact surface area of the shoe, when worn, with the second heel assembly in the deployed position.

16. The shoe as defined in claim 15, wherein the rotating mount is disposed about a longitudinal axis of the first heel assembly at the seat of the sole, the upper portion of the second heel assembly is attached to the rotating mount such that the heel assembly can rotate about the longitudinal axis of the first heel assembly and can pivot into the stowed position.

17. The shoe as defined in claim 16, wherein the rotating mount includes a plurality of bearings to facilitate rotation about the longitudinal axis.

18. The shoe as defined in claim 15, wherein the first heel assembly has a stiletto profile and the second heel assembly has a spool heel profile.

19. The shoe as defined in claim 15, wherein, in the deployed position, the second heel assembly is positioned forward of the first heel assembly in the deployed position.

20. The shoe as defined in claim 15, wherein, in the deployed position, the second heel assembly is positioned aft of the first heel assembly in the deployed position.

* * * * *